US005154638A

United States Patent [19]

Sireul et al.

[11] Patent Number: 5,154,638

[45] Date of Patent: Oct. 13, 1992

[54] HIGH-VOLTAGE CONNECTOR FOR AN X-RAY TUBE

[75] Inventors: Jacques Sireul, Wissous; Hans Jedlitschka, Chatillon; Jean-Michel Miquel, Paris, all of France

[73] Assignee: General Electric CGR SA, Issy-Les-Moulineaux, France

[21] Appl. No.: 618,217

[22] Filed: Nov. 21, 1990

[30] Foreign Application Priority Data

Nov. 24, 1989 [FR] France ..... 89 15507

[51] Int. Cl.[5] ..... H01R 17/00

[52] U.S. Cl. ..... 439/611; 439/618

[58] Field of Search ..... 439/611, 618, 683, 678, 439/679, 719

[56] References Cited

U.S. PATENT DOCUMENTS

| | | | |
|---|---|---|---|
| 1,542,366 | 6/1925 | Brough | 439/618 |
| 2,297,449 | 9/1942 | Baumbach | 439/683 |
| 4,127,313 | 11/1978 | Marks | 439/618 |
| 4,211,465 | 7/1980 | Duhale et al. | 439/618 |
| 4,379,978 | 4/1983 | Hochenbrock | 439/611 |
| 4,755,754 | 7/1988 | Sireul et al. . | |
| 4,923,295 | 5/1990 | Sireul et al. . | |
| 4,944,501 | 7/1990 | Sireul et al. . | |

FOREIGN PATENT DOCUMENTS

| | | | |
|---|---|---|---|
| 0649410 | 1/1951 | United Kingdom | 439/618 |

*Primary Examiner*—Larry I. Schwartz
*Assistant Examiner*—Hien D. Vu
*Attorney, Agent, or Firm*—Pollock, VandeSande & Priddy

[57] ABSTRACT

A high-voltage connector, in particular for feeding the cathode, two cathode filaments, and two gates of an X-ray tube, wherein the connector comprises five connections, one for power supplying the cathode, two for power supplying the cathode filaments, and the last two for power supplying the two gates, the connections being disposed in such a manner that the distance between the cathode connection and a gate connection and the distance between the two gate connections are greater than the distance between the cathode connection and a cathode filament connection.

5 Claims, 2 Drawing Sheets

HIGH-VOLTAGE CONNECTOR FOR AN X-RAY TUBE

BACKGROUND OF THE INVENTION

1. Field of the Invention

The invention relates to devices for supplying electrical power to X-ray tubes and more particularly, in such devices, it relates to connectors which are used for making electrical connections between the electrical power supply and the X-ray tube disposed in a tank filled with an insulating and cooling medium.

2. Description of the Prior Art

In diagnostic X-ray installations, the X-rays are generally produced by means of an X-ray tube. In one usual disposition, the X-ray tube is contained in a metal casing filled with an electrically insulating oil, with the casing being intended, in particular, to protect users against electric shock and against X-rays. The casing fitted with an X-ray tube is referred to as an X-ray source assembly. The components of the power supply for the X-ray tube and in particular the components of a high-voltage generator producing the high-voltage power supply for the X-ray tube are housed together in a different enclosure situated at a distance from the X-ray source assembly. Depending on the type of high-voltage power supply used, i.e. single pole or symmetrical, one or more highly-insulated electric cables convey the positive and negative polarities of the high voltage into the casing containing the X-ray tube via electrical connection devices. One such electrical connection device or connector is constituted by two portions, one of which, called the "receptacle" constitutes a female part which is permanently fixed on the casing, while the other portion constitutes a male part or "plug" which is intended to be received in the receptacle and which is fixed to the cable. Given the very high values that may be reached by the power supply voltage of an X-ray tube, e.g. 150 kV, the receptacle and the plug are made of electrically insulating materials and their shapes and sizes are defined by international standards. In order to protect users, the casing is connected to ground potential as is an outer sheath on the, or each, cable, with one of the perpetual concerns of manufacturers being that all the outside surfaces of the cables and of the casing of the connection device should be metallic and that there should be electrical continuity between all these members.

The electrical contact(s) provided by an electrical connection device occur in the bottom of the receptacle between first contact members fixed to the plug and second contact members fixed to the receptacle and passing through the bottom wall thereof, thus gaining access to the inside of the casing. The receptacle extends relatively deeply into the casing so that the end of the second contact element extends into the inside of the casing at a sufficient distance from the inside wall thereof to avoid electrical discharge between the metal casing which is grounded and the contact element which is at the high potential. Assuming that the polarity conveyed is negative, this contact is connected by a link conductor to the cathode of the X-ray tube, while the anode thereof is connected to the positive polarity via another link conductor inside the casing extending between the anode and another contact member of another electrical connection device.

However, on their own, these precautions are not sufficient for avoiding the risks of electrical discharges inside the casing and proper electrical insulation therein can be obtained only if the casing is filled with an electrically insulating oil or fluid. Under these conditions, it is impossible, in practice, in spite of the presence of an insulating oil, to place a metal component inside the casing close to the receptacle.

Depending on the type of X-ray tube used, the connectors have three or four connections which are spaced apart around a circumference having a diameter of 20.62 millimeters with the usual standards. For a three-connection connector, the connections are disposed at 120° from one another. For a four-connection connector, a fourth connection is added on the same circumference halfway between two of the first three connections that are at 20° intervals.

In new X-ray apparatuses, X-ray tubes are used which include, in addition to the cathode and the anode, electrodes referred to as "grids" or "gates" which serve to alter the path of the electron beam emitted by the cathode, or else to modulate it, or indeed to focus it better. The voltages applied to these gates may lie in the range several tens of volts to several kilovolts, and it is therefore necessary to provide power supplies for them via appropriate connectors.

Naturally, it would be possible to add another connector to the wall of the cooling tank in order to power supply these gates, however such a solution takes up space and increases the cost of the assembly.

The object of the present invention is therefore to provide a high-voltage X-ray tube connector having five connections, thereby power supplying the cathode, two cathode filaments, and two gates.

SUMMARY OF THE INVENTION

The present invention provides a high-voltage connector, in particular for power supplying the cathode, two cathode filaments, and two gates of an X-ray tube, the connector being characterized in that it comprises five connections, one for supplying the cathode, two for supplying the cathode filaments, and the last two for supplying the two gates. The connections are disposed in such a manner that the distance between the cathode connection and a gate connection and the distance between the two gate connections are greater than the distance between the cathode connection and a cathode filament connection.

Preferably, the connections are distributed around a circumference in such a manner that the angle separating the cathode and filament connections is smaller than the angle separating the cathode connection and a gate connection, or the angle separating the two gate connections, or a gate connection from the closest filament connection.

These various angles are such that the angle between the cathode and filament connections is about 60° and the angle between a gate connection and the other gate connection or the closest filament connection is about 80°.

In conventional manner, the high-voltage connector comprises a female portion and a male portion in the form of respective nesting cylindrical tubes, the connector being characterized in that the inside wall of the cylindrical tube of the male portion includes five longitudinal ribs angularly spaced apart in the same manner as the connections, said ribs serving during assembling to center a cable and to guide the conductors of said cable.

BRIEF DESCRIPTION OF THE DRAWINGS

Other characteristics and advantages of the present invention appear from reading the following description of a particular embodiment, said description being made with reference to the accompanying drawings, in which.

DETAILED DESCRIPTION OF THE INVENTION

Figure 1:
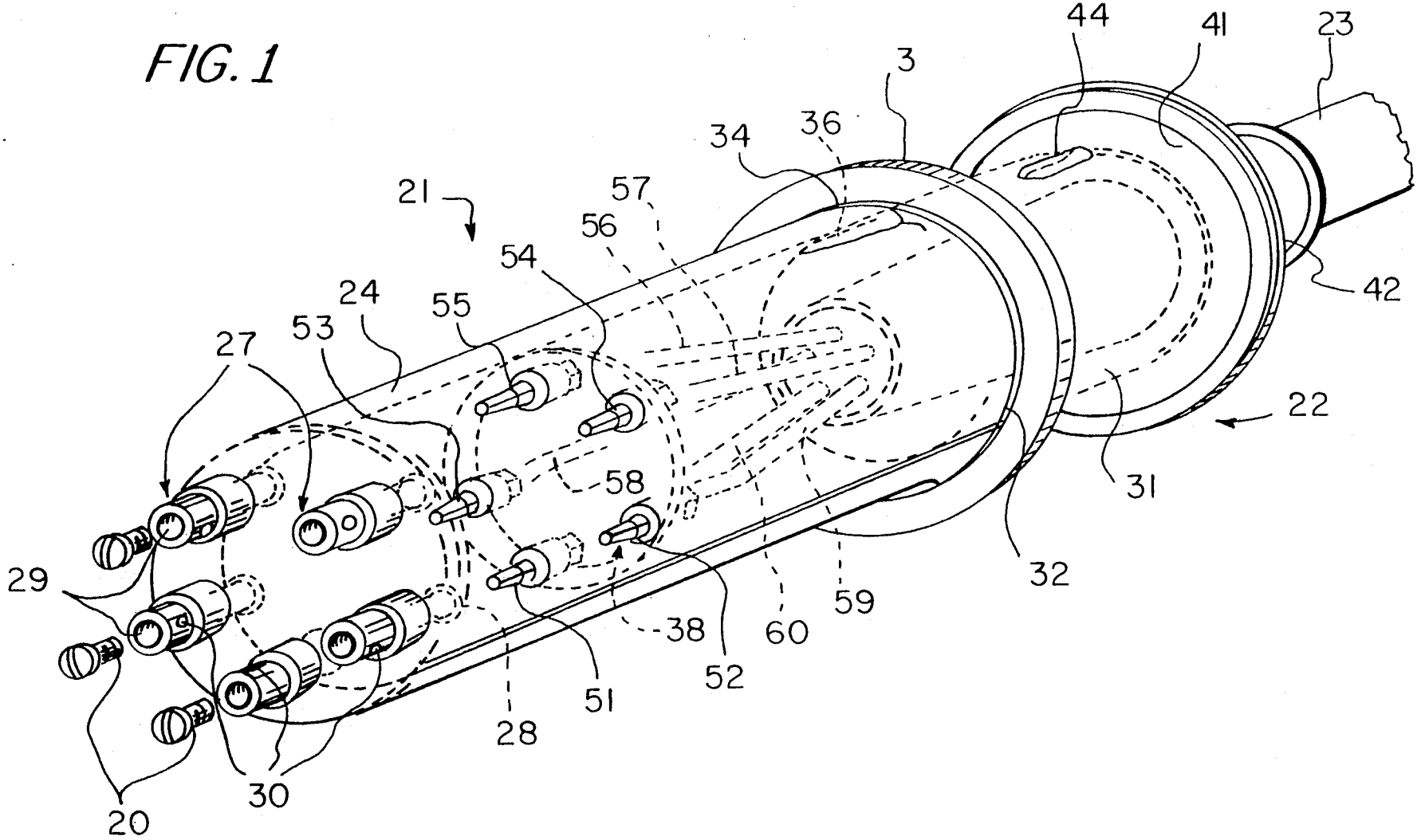
FIG. 1 is an isometric perspective view of the male and female portions of a high-voltage connector of the present invention.
Figure 2:
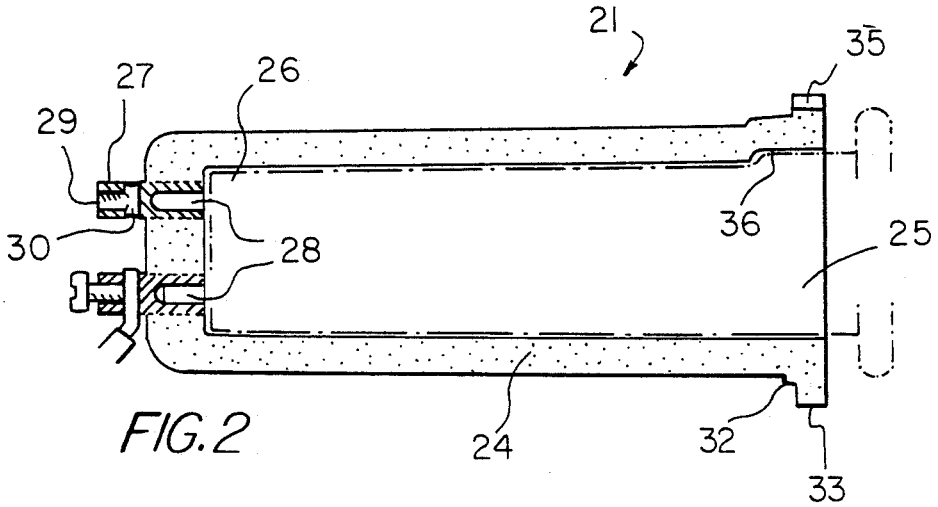
FIG. 2 is a longitudinal section through the female portion of the connector of the invention.

A high-voltage connector for an X-ray tube comprises (FIGS. 1 and 2) a female portion 21 which is fixed in a fluid tight manner to the wall of the casing, and a male portion 22 which is moveable relative thereto and is fixed to the end of a cable 23 containing a plurality of conductors. The female and male portions 21 and 22 are in the form of elongate cylindrical tubes 24 and 31 whose dimensions are such that the male portion is easily received in the female portion. The cylindrical tube 24 of the female portion 21 is open at one end 25 for receiving the male portion 22, and it is closed at its other end 26 for supporting connection inserts 27, of which there are five according to the present invention. Each connection insert 27 (FIG. 2) passes through the thickness of the end of the tube 24 and comprises, at its end inside the tube, a receptacle 28 for receiving a male connector pin, and its end outside the tube it comprises a conventional connection terminal 29, e.g. of the type comprising a hole 30 and a clamping screw 20 in order to fix an electrical conductor providing a link to one of the electrodes of the X-ray tube.

The open end 25 of the cylindrical tube 24 is terminated by a first collar 32 for centering the tube in the orifice through the wall of the casing, and by a second collar 33 constituting a flange for bearing against said wall via a gasket (not shown).

The outside of the collar 32 is provided with a shape 34 for defining its position relative to the orifice through the wall. The outer collar or flange 33 is provided externally with a first notch 35 for marking the position of the cathode connection, and internally with a second notch 36 for defining the position of the male portion.

Figure 3:
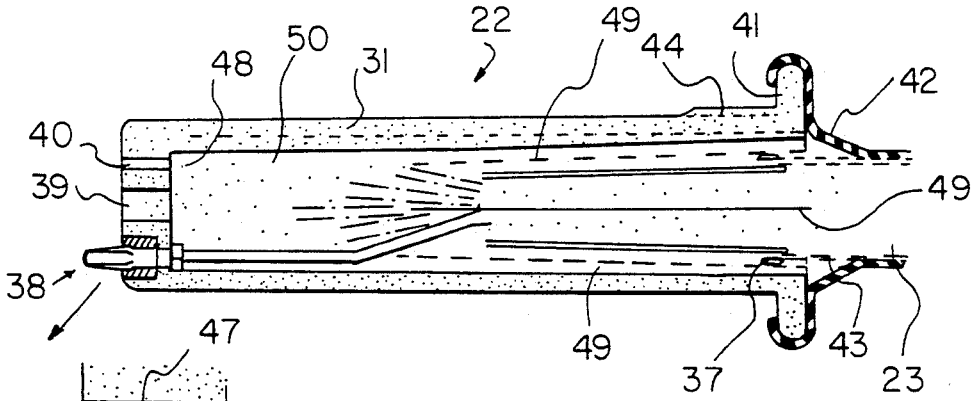
FIG. 3 is a longitudinal section through the male portion of the connector of the invention.

The cylindrical tube 31 of the male portion of the connector is open at one end 37 (FIG. 3) in order to receive the cable 23, and it is closed at its other end 48 in order to carry the male pins 38, of which there are five. Each male pin comprises a base which is hollow in the middle to receive one of the conductors of the cable 23. The base is hexagonal in shape with one of its flats coming into abutment against the inside wall, and it is extended by a circularly cylindrical contact 45 which is fitted with flexible springs 46 that provide the electrical contact with the receptacle 28 in the female portion. Above the base, the contact is threaded over a certain length to co-operate with a centering ring 47. Each male pin 38 is held in an orifice through the end 48 by means of the ring 47 which screws onto the threaded portion of the contact 45. In addition to the five holes for passing the five male pins, the end 48 has two holes, one of them, 39, serving as a filler hole for a potting substance, while the other one 40, serves as a vent during the potting operation.

The cylindrical tube 31 is terminated at its open end 37 by a flange 41 having a ferrule 42 crimped thereon, with the ferrule being in contact with the metal braid 43 of the cable 23. This ferrule serves to ground the metal braid of the cable.

The outside surface of the tube 31 has a key 44 projecting from the flange 41 for co-operating with the notch 36 in the tube 24. The inside wall of the tube 31 includes five longitudinal ribs 49 extending from the open toward the closed end of tube 31 which are at the same angular spacing as the connections, with each angular space round the wall corresponding to one connection. During assembly with the cable 23, these ribs serve both as centering devices and as guides for the five conductors 56 to 60 of the cable 23.

In order to assemble the cable 23 inside the tube 31, the conductors 56 to 60 are initially preformed and soldered to the pins 38. The cable 23 is then slid into the tube 31 with the ribs 49 serving to guide the pins from the open end toward the closed end so that the contacts of the pins 38 pass through the end holes. The rings 47 are then screwed onto the threaded portions of respective pins in order to hold them in place. The metal ferrule 42 which was put in position around the cable prior to assembling the cable in the tube 31 is then crimped around the metal braid 43 and around the flange 41. Finally, the last operation consists in filling the inside volume of the tube 31 via the orifice 39 with a potting substance 50 so as to hold the cable 23 and the conductors 56 to 60 in place and so as to insulate the conductors from one another and from ground.

Figure 4:
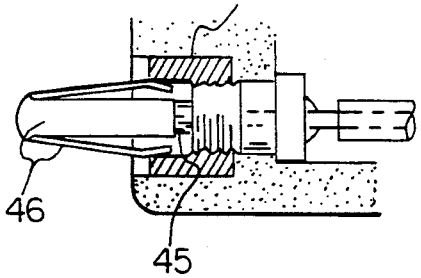
FIG. 4 is an end view of the male portion of the connector of the invention.
Figure 4:
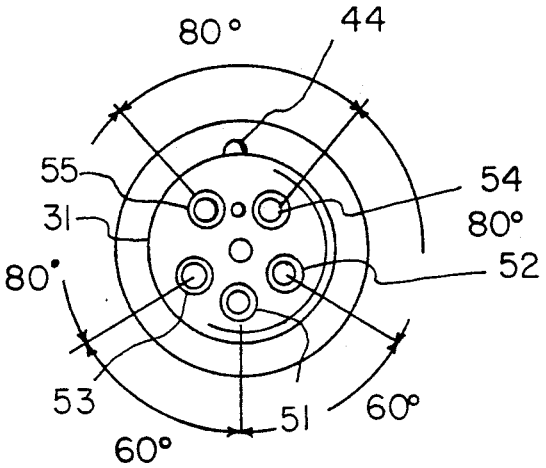

According to the invention, the connection inserts 27 and thus the contact pins 38 are respectively distributed at the ends of the tubes 24 and 31 as shown in FIG. 4 which is an end view of the contact pin of the male portion 22. The pin 51 corresponds to the high-voltage power supply for the cathode, at about 70 kV relative to ground. The pin 52 serves to power supply a cathode filament for obtaining a beam of electrons that gives rise to a large-sized X-ray focal area. The pin 53 serves to power supply a cathode filament for obtaining a beam of electrons that gives rise to a smaller-sized X-ray focal area. The pin 54 serves to bias a first gate, and the pin 55 serves to bias a second gate.

The pins 52 and 53 are disposed close to the pin 51 since they are at substantially the same potential as the cathode potential, differing therefrom by a few tens of volts only. In contrast, the pins 54 and 55 should be further away from the pins 51, 52, and 53 since they are at potentials which differ from each other and from the high voltage by several kilovolts. It is therefore recommended for the distance between the cathode connection and a gate connection, and for the distance between the two gate connections to be greater than the distance between a cathode connection and a filament connection.

In FIG. 4, the five pins are disposed on a common circumference the diameter of which satisfies the usual standards for three-connection or four-connection connectors, i.e. 20.62 millimeters in diameter. In addition, the five pins are angularly spaced apart so that the pins 51, 52, and 53 are separated by an angle of about 60°, whereas the pins 52, 53, 54, and 55 are separated by angle of about 80°, thereby making it possible to satisfy the above-mentioned spacing rules. It should be observed that the values specified for the diameter and for the angles are given purely by way of example, and they could therefore differ about the values given.

What is claimed is:

1. A high voltage connector for an X-ray tube comprising:

a male member having a cylindrical tube open at one end for receiving a multi-conductor cable terminated with a plurality of at least five male plugs, said plugs being supported at an opposite closed end through holes in said closed end, said cylindrical tube including a plurality of ribs extending from said open end toward said closed end for guiding said plurality of male plugs into said holes;

a female member having a cylindrical tube open at one end for receiving said male member cylindrical tube, and closed at an opposite end having a plurality of holes for supporting a plurality of at least five female plugs spaced apart in a configuration for receiving each of said male connections to said X-ray tube which include filament connections, cathode connections, and gate connections, the distance between said gate connections and said cathode connections being greater than the distance between said cathode connections and said filament connections, whereby connections having a greater voltage potential difference are spaced a greater distance from each other.

2. A high-voltage connector according to claim 1, wherein a cathode connection and the filament connections are spaced apart by an angle which is smaller than the angle between the cathode connection and a gate connection or the angle between two gate connections, or the angle between a gate connection and the nearest filament connection.

3. The high voltage connector of claim 1, wherein each male member cylindrical tube is filled with a potting compound.

4. A high-voltage connector according to claim 1, wherein the connections are distributed around a circumference such that a cathode connection is disposed between two filament connections, and two gate connections are disposed between the two filament connections.

5. A high-voltage connector according to claim 2, wherein the angle separating the cathode and filament connections is about 60° and in that the angle separating the gate connections from each other or from the nearest filament connection is about 80°.

* * * * *